United States Patent [19]

Goessler et al.

[11] Patent Number: 4,633,238

[45] Date of Patent: Dec. 30, 1986

[54] TEMPERATURE LIMITER FOR A GLASS-CERAMIC COOKING UNIT

[75] Inventors: Gerhard Goessler, Oberderdingen; Eugen Wilde, Knittlingen; Willi Essig, Boeblingen; Edgar Hanss, Waldbronn, all of Fed. Rep. of Germany

[73] Assignee: E.G.O. Elektro-Geräte Blanc u. Fischer, Fed. Rep. of Germany

[21] Appl. No.: 649,530

[22] Filed: , Sep. 11, 1984

[30] Foreign Application Priority Data

Sep. 17, 1983 [DE] Fed. Rep. of Germany ..... 3333645
Mar. 22, 1984 [DE] Fed. Rep. of Germany ..... 3410442

[51] Int. Cl.[4] ..... G08B 21/00
[52] U.S. Cl. ..... 340/593; 219/446; 219/449; 219/512; 337/394; 340/540
[58] Field of Search ..... 340/593, 594, 540; 337/394, 392, 400; 219/446, 449, 512, 510, 453

[56] References Cited

U.S. PATENT DOCUMENTS 1,651,972 12/1927 Smalley .
3,906,424 9/1975 Clancy et al. .
4,135,081 1/1979 Fischer ..... 219/449
4,544,831 10/1985 Bayer ..... 219/449

FOREIGN PATENT DOCUMENTS 964729 1/1950 Fed. Rep. of Germany .
1806651 6/1969 Fed. Rep. of Germany .
7826549 7/1978 Fed. Rep. of Germany .
2748109 5/1979 Fed. Rep. of Germany .
2839161 3/1980 Fed. Rep. of Germany .
3100758 1/1981 Fed. Rep. of Germany .
2943477 7/1981 Fed. Rep. of Germany .
2435796 4/1980 France .

OTHER PUBLICATIONS

U.S.-Buch: Ricter-: Bauelemente der Feinuechnik, Uerlag Technik Berlin, 1952, S. 123-125.

*Primary Examiner*—Glen R. Swann
*Attorney, Agent, or Firm*—Steele, Gould & Fried

[57] ABSTRACT

A temperature sensor for a temperature limiter is made up of an outer tube and a number of inner component rods. The temperature sensor extends transversely over the top side of a moulding of a heating system for a glass-ceramic cooking unit. The heating system comprises a central heating surface and an outer connectable heating surface disposed in a circle therearound. Disposed in the zone of the central heating surface is an inner component rod whose coefficient of expansion is lower than that of the outer tube, while in the zone of the connectable heating surface the component rods have a higher coefficient of expansion than the outer tube.

12 Claims, 6 Drawing Figures

TEMPERATURE LIMITER FOR A GLASS-CERAMIC COOKING UNIT

BACKGROUND OF THE INVENTION

1. Field of the Invention

The invention relates to a temperature limiter for a glass-ceramic cooking unit, and in particular to one having a substantially rod-shaped temperature sensor which has an outer tube containing an inner rod with a different coefficient of expansion. The rod actuates a signal switch disposed in a base to indicate the heating state of the glass-ceramic cooking surface and actuates via a pivotable lever a circuit breaker also disposed in the base for switching the heating system of the glass-ceramic cooking unit off at a limiting temperature lying just below the permissible temperature of the glass-ceramic cooking surface.

2. Prior Art

A temperature limiter of the general kind specified is known (German Offenlegungsschrift No. 28 39 161 dated Mar. 20, 1980). In that prior art apparatus the temperature sensor is mounted to be pivoted in relation to the base via ball bearings. The signal switch is actuated by the same lever which also actuates the circuit breaker. The temperature sensor is engaged with a point on the lever lying between the two switches, so that any increase in the travel of the temperature sensor is used for actuating the signal switch. With this prior art temperature switch adjustment can be performed only when the temperature limiter is attached to the heating element of the glass-ceramic cooking unit. The temperature sensor is rigidly fixed on the sheet metal plate, while the base can be aligned to some extent due to the pivotable construction. Only then can adjustment be performed. It has been found that during the operation of the apparatus the adjustment may alter, due to the influences of ageing and also mechanical displacements.

An electric cooking apparatus is also known which has a temperature limiter expansion member acting on two switch contacts, one of which is used for the indication of a signal device, the other being used for switching off the heating system (German Patent No. 27 48 109 published May 3, 1979). To this end a wire disposed in the tube is clamped to a resilient strip whose free, lever-forming end has an insulating member which actuates the two contacts.

SUMMARY OF THE INVENTION

The invention has an object of providing a temperature limiter and a temperature sensor therefor, which can be adjusted before the temperature limiter is incorporated in the heating element, and in which the switching temperature once adjusted remains unchanged for a prolonged period.

To this end according to the invention the outer tube is rigidly connected to the base, and the actuating and contact point of the signal switch lies in a substantially rectilinear line of extension of the inner rod, so that the inner rod directly actuates the signal switch. According to the invention, therefore, the signal switch is no longer operated via a lever transmission, but directly by the inner rod of the temperature sensor. As a result, ageing phenomena such as occur with the prior art lever transmission can no longer affect the precise response of the signal switch. Due to the rigid connection between the outer tube and the base, adjustment can be carried out even before the apparatus is incorporated in the heating element, and this gives considerable advantages in large-scale serial production. No further adjustment work need be carried out, even when a temperature limiter is replaced on a cooking unit already installed.

Also according to the invention at that end of the lever which is acted upon by the inner rod it can have an insulating knob extending into the line of extension of the inner rod. This is a very simple method of separating the two switches galvanically from one another. Since the insulating knob extends into the path of the inner rod, the signal switch is still directly actuated by the inner rod, without the interposition of any kind of lever transmission. In practice the insulating knob forms an extension of the inner rod.

According to a further feature of the invention, the connecting parts of the signal switch can be inserted through slots in the bottom of the bases and twisted on its outer side; multiple bent straps can be welded on to the twisted ends, be borne in slots or grooves in the base, and terminate in flat insertion tongues. The insertion of the connecting parts through slots in the base has the advantage that the switch parts can be precisely located and their position remains fixed. The connection to the multiple bent straps has the advantage that forces generated when the connecting wires are applied do not act directly on the switch parts, so that the position of the switch is not altered even if supply wires are repeatedly applied and detached, and no changes take place in adjustment. Even if the connecting wires are levered on to the flat insertion tongues, no forces are transmitted to the signal switch, since the straps bear against the base.

Also according to the invention the inner rod can comprise a number of component rods. The result is that different temperature sensor lengths, such as are needed for heating elements of different sizes, do not call for the production and storage of a number of inner rods, since the various sizes can be built up by putting individual modular rods together. This step also has the advantage that even if the outer tube is slightly bent, the inner rod cannot get jammed, in a way which might result in a slight displacement of the response temperatures.

According to a further feature of the invention the inner rod can be acted upon by the pressure of a spring. As a result, the temperature sensor responds rapidly and accurately to both increases and decreases in temperature.

According to a possible feature of the invention the outer tube is made of metal and the inner rod of steatite. This means that the outer tube has a higher coefficient if expansion than the inner rod. The lever and the signal switch are therefore acted upon by pressure.

To protect the temperature sensor a preferably quartz glass protective tube can be slipped over the outer tube. This means that on the one hand the temperature sensor itself is protected against mechanical or thermal influences, and on the other hand the protective tube made of insulating material also provides electrical protection, so that the distance between the temperature sensor and the coils of the heating system can be reduced in certain circumstances.

The protective tube can, for example, be retained loosely in a cap in which the end of the outer tube remote from the base is mounted and which is adapted to engage in a matching aperture in a sheet metal plate of a heating element. Such loose retention is possible, since the protective tube performs a purely protective function.

According to a possible feature of the invention the base is borne on two attachments engaging in slots in a sheet metal plate of the heating system and is possibly attached to the sheet metal plate via an additional bowed member. The attachments co-operate with the slots in the sheet metal plate to produce a centering, while the attachment with an additional bowed member provides further security against displacement or the like.

To enable the precision of the switching temperatures to be further increased, according to a possible feature of the invention force is transmitted from the lever to the circuit breaker via an adjusting screw and a bearing element which has at least one and preferably two flat bearing surfaces and is disposed resiliently between the adjusting screw and the actuating point of the circuit breaker. As a result no direct contact takes place between the adjusting screw and the actuating point of the circuit breaker. Since because of being disposed on the lever the adjusting screw would engage with the actuating point from different directions, in dependence on the position of the lever, and the front end of the adjusting screw may not always be completely axially symmetrical, different degrees of accuracy might occur with different positions of the adjusting screw. This is prevented by the interposition of the bearing element, whose smooth, flat surfaces result in unalterable conditions. More particularly the bearing element can advantageously be mounted on the lever itself.

According to a further feature of the invention, this can be done by the bearing element being a flat-head rivet attached to the free end of a drag lever disposed on the main lever. Due to the mounting of the drag lever on the main lever, its inherent rigidity eliminates the effects of any play of the adjusting screw in its threading.

According to a further possible feature of the invention, the spring engages with the lever in the zone of the adjusting screw. If the spring, for example, is a helical spring, this results in space-saving accommodation, since the adjusting screw must be accessible from outside, and space for an aperture is available at this place.

Also according to the invention the end of the outer tube remote from the base has a second adjusting screw for adjusting the temperature of response of the signal switch. This adjustment can also be performed before the temperature limiter is incorporated in the heating system.

In glass-ceramic cooking apparatuses in which the cooking places have a number of heating zones which can be connected separately, there is basically the problem that the temperature of the glass-ceramic cooking surface cannot be precisely adjuted by an adjusting temperature if only one temperature sensor is used. The reason is that with the operation of only one heating system, the temperature sensor is acted upon by heat only over a relatively small zone, while if two or more heating systems are used, the temperature sensor is acted upon over a larger zone, so that it apparently produces a higher temperature.

According to the invention with a cooking place having at least one additional heating surface connectable to a basic heating surface, the outer tube (13) and/or the inner rod (14) is subdivided substantially corresponding to the subdivision between the basic heating surface and the at least single additional heating surface, and the coefficient of expansion of the at least single basic component rod (**14*b*) and/or component tube (81) associated with the basic heating surface differs from the coefficient of expansion of the at least single additional component rod (14*a,c***) and/or component tube associated with the additional heating surface.

The basic heating surface therefore acts exclusively on the at least single component rod, with which it is spatially associated. The additional heating surface then acts on the at least one additional component rod spatially associated therewith. In what follows, therefore, these component rods will be referred to as the basic and additional component rod.

This construction of the temperature sensor according to the invention enables the at least two heating surfaces to exert different temperature influences on the temperature sensor. For example, a continuous outer tube can have a number of component inner rods; for example, in the zone of the basic heating surface the component rod can have a lower coefficient of expansion than the outer tube, while a component rod with a different coefficient of expansion is disposed in the zone of the connectable heating surface. Preferably the temperature sensor extends over the cooking place along a diameter, but it can also be slightly offset laterally. The use of different materials with different coefficients of expansion and the construction of the inner rod and/or the outer tube in parts makes enough parameters available to ensure that the temperature of response of the temperature sensor is actually independent of whether only the basic heating surface or also the at least single connectable heating surface are operating. Often in the active zone—i.e., that corresponding to the basic heating surface—the coefficient of expansion of the inner rod is lower than the coefficient of expansion of the outer rod in the same zone. For the outer rod, for example, a high-quality steel can be used, while the inner rod is made of ceramics, which have a lower coefficient of expansion than the high-quality steel. In this case according to the invention the coefficient of expansion of the additional component rod—i.e., the one associated with the connectable heating surface—is at least as high as that of the outer tube in that zone.

Also according to the invention, to allow a particularly rapid reaction to the additional heating surface, the coefficient of expansion of the additional component rod in this case is higher than the coefficient of expansion of the outer tube in the zone of the additional heating surface.

Of course, the temperature sensor can also be so constructed in its active zone that the inner rod has a higher coefficient of expansion than the outer tube in the active zone—i.e., the zone associated with the basic heating surface. In such a case according to the invention the coefficient of expansion of the component rod associated with the connectable additional heating surface is at most as high as that of the outer tube in the zone of the connectable heating surface. To ensure as rapid and inertia-free a response as possible, in this case also the coefficient of expansion of the component rod is advantageously lower than that of the outer tube.

It has been found particularly advantageous for the difference between the coefficient of expansion of the outer tube and that of the component rod associated with the connectable heating surface to lie in the range of 0 to $10^{-5}$ 1/K, preferably at about $0.5 \cdot 10^{-5}$ 1/K.

It has been found that this difference between the coefficients of expansion gives particularly favourable results. Also according to the invention the difference between the coefficients of expansion of the basic component rod and of the outer tube in this zone lies in the range of about 2.5 to $18 \cdot 10^{-6}$, preferably at about $1.3 \cdot 10^{-5}$.

The invention can be used more particularly in cooking places in which each connectable heating surface is disposed in a circle around the basic heating surface disposed in the center. Of course, a number of annular connectable heating surfaces can be used. In that case the switch acted upon by the temperature senser must be disposed outside the outermost annular zone. Although it is of course possible for the temperature sensor to extend over the whole area of the cooking place, advantageously the temperature sensor can extend from the outer edge of the cooking place over its centre as far as the opposite separating place between the central heating surface and the connectable heating surface. In this case also the steps according to the invention can be advantageously used.

Advantageously the outer tube can at least be partially unitary with a casing of the switch acted upon by the temperature sensor. For example, the ceramic casing of the switch can have a tubular attachment extending over a connectable heating surface about as far as the separating line between such surface and the basic heating surface.

BRIEF DESCRIPTION OF DRAWINGS

Further features, details and advantages of the invention will be gathered from the claims, the following description of a preferred embodiment, and the drawings, wherein:

DETAILED DESCRIPTION OF THE PREFERRED EMBODIMENTS

Figure 1:
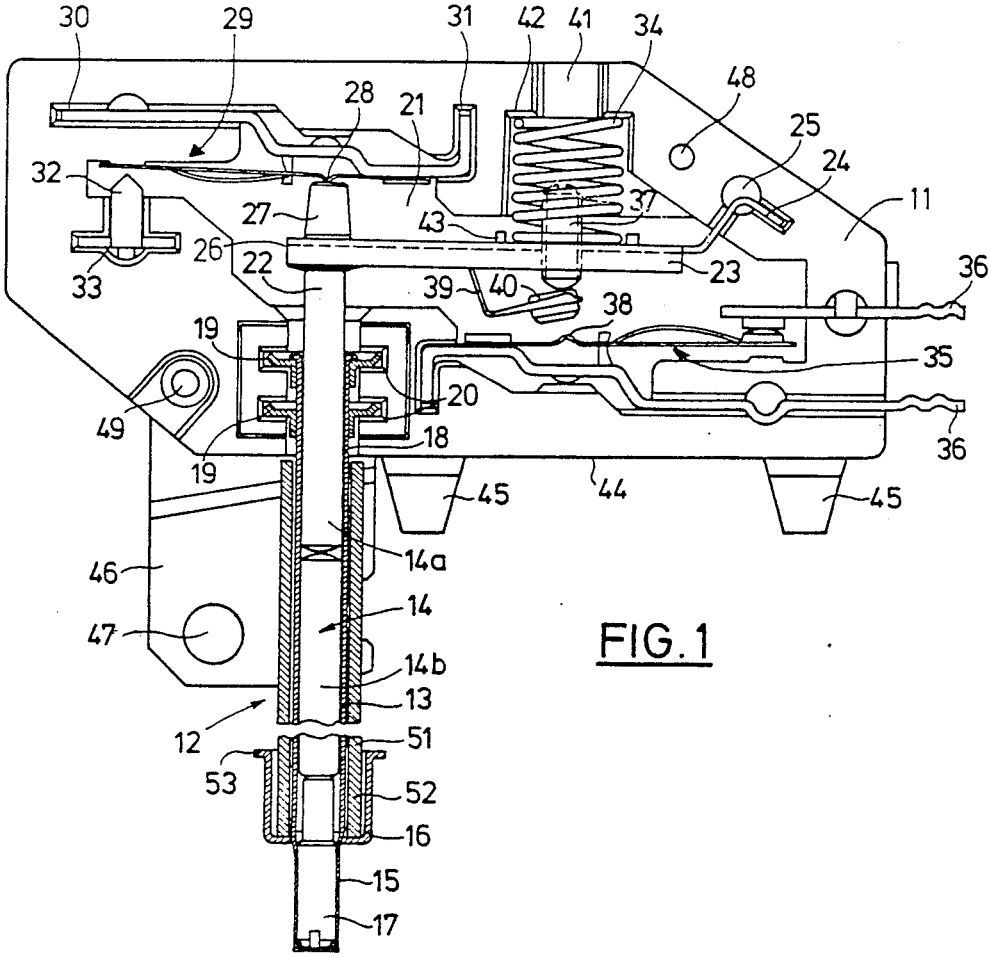
FIG. 1 is a partially sectioned elevation, to an enlarged scale, of a temperature sensor according to the invention which forms part of a temperature limiter.

The temperature limiter illustrated in FIG. 1 contains a base 11 which is preferably made from steatite. Attached to the base 11 is a temperature sensor 12 comprising a metal outer tube 13 and an inner rod 14 disposed inside the outer tube 13. At its end 15 remote from the base the outer tube 13 has a reduced diameter. At that end the outer tube 13 is inserted through an opening in a cap 16. The end 15 has an internal screwthreading, into which an adjusting screw 17 is screwed.

At its base side end 18 the outer tube 13 has two spaced-out, circularly extending, substantially plate-shaped flanges 19 which engage in a matching angular groove 20 in the base 11. The outer tube 13 is rigidly connected to the base 11 via the flanges 19.

The inner rod 14 extends out of the outer tube 13 into the inside 21 of the base 11. The inner end 22 of the inner rod 14 bears against a lever 23 whose right-hand bent end 24 is located in a recess 25 in the base 11. The located end 24 forms the pivot around which the lever 23 can be pivoted. At its free end 26 the lever 23 has a hole (not shown) disposed in alignment with the inner rod 14 through which an insulating knob 27 is inserted, which has a widened head on the side adjacent the inner rod 14 and is rigidly connected to the lever 23.

When the lever 23 is pivoted, the insulating knob 27 performs a substantially linear movement in the direction of the inner rod 14. Its top end acts on the actuating point 28 of a signal switch 29 constructed in the form of a snap switch. In FIG. 1 the signal switch 29 is shown in the switched-off condition, meaning that the signal indication has not yet been switched on. The snap switch, of conventional construction, is located in slot-like recesses 30, 31 in the steatite base 11. The second contact 32, which has a tip, is located in another slot-like recess 33.

On the right of the snap switch 29 the lever 23 is urged downwards by a helical spring 34 (FIG. 1), the spring 34 acting on the lever 23 to urge the inner rod 14 downwards (FIG. 1). When the temperature sensor 12 heats up, the metal outer tube 13 expands more than the inner rod 14, so that the inner end 22 of the inner rod 14 slowly moves downwards during heating, and at a predetermined displacement, corresponding to the reaching of a predetermined temperature, the signal switch 29 snaps over and makes a conductive connection with the contact 32. As a result a circuit is closed which contains a signalling device, for example, an incandescent lamp.

On the right of the temperature sensor 12, the steatite base 11 has another switch 35 which is constructed in the form of a snap switch and is used for switching the electric heating system of an associated glass-ceramic cooking unit. The snap switch is of conventional construction and located in slot-like recesses. The connections 36 extend laterally out of the base 11.

The lever 23 has a screwthreaded hole into which an adjusting screw 37 is screwed. The longitudinal axis of the adjusting screw 13 passes substantially through the actuating point 38 of a circuit breaker 35. Attached, for example, welded to the lever 23 is a drag lever 39 made of thin sheet metal. The free end of the drag lever 39 has a flat-head rivet 40 which lies between the adjusting screw 37 and the actuating point 38 of the circuit breaker 35. The flat-headed rivet 40 has a smooth, flat underside directed towards the actuating point 38, and a smooth, flat top side directed towards the adjusting screw 37.

The flat-head rivet 40 can be set to a varying distance from the lever 23 by turning the adjusting screw 37. When the lever is pivoted, therefore, it is not the adjusting screw 37 directly but the flat-head rivet 40 which engages via its smooth, flat underside with the actuating point 38 of the circuit breaker 35. This allows high precision adjustment at the response temperature of the circuit breaker 35. On the axis of the adjusting screw 37 and away from the circuit breaker 35 the base 11 is formed with an opening through which the adjusting screw 37 is accessible, for example, by means of a screwdriver. The opening 41 has a circularly extending shoulder 42 against which the top end of the helical spring bears. For guiding the bottom end of the helical spring 34 the lever 23 has on its top side three cam-like attachments 43, only two of which are shown in the drawing.

When the temperature senser 12 becomes heated and the preferably high-quality outer tube 13 expands, therefore, the signal switch 29 is first closed, this taking place at a temperature of about 50°–60° C. Then, at a substantially higher temperature, higher by about a power of ten, the circuit breaker 35 is opened, thus interrupting the supply of current to the electric heating system. Both take place by means of the same temperature sensor, the special construction enabling both temperatures to be precisely adjusted.

On its side 44 adjacent the heating element, the base 11 has two substantially truncated pyramidal attachments 45 which engage in matching slots in a sheet metal plate of the heating element of the glass-ceramic cooking unit, thereby centering the base 11 laterally and at the correct angle. To further improve the attachment of the base 11, the sheet metal plate has a bowed member 46 which is formed with a hole 47, and a hole (not shown) corresponding to the hole 49 in the base 11, and also recesses, corresponding to the slots 50 (FIG. 2) for screw or rivet attachment.

Figure 2:
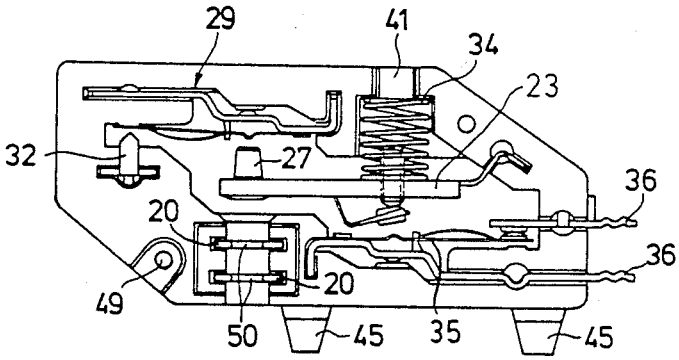
FIG. 2 is a view, to a reduced scale, of the base of the temperature limiter illustrated in FIG. 1, without the temperature sensor.

The base is also formed with a hole 48 on to which a cover can be riveted. It is enough to rivet it on at one hole. FIG. 2 shows the base with the switches 29 and 35 disposed therein, without the temperature sensor 12. It can be seen how the annular grooves 20 for the flanges 19 of the outer tube 11 have in the bottom of the base 11 slots 50 through which the metal parts disposed on the outer edges of the flanges 19 can be inserted and then twisted on the underside of the base (FIG. 3), thus locating the outer tube 13 accurately and free from clearance. This attachment is further reinforced by the provision of two such flanges 19, annular grooves 20 and slots 50. Since the bowed member 46 is also formed with recesses matching the slots 50, the bowed member 46 can also be securely located at the same time by means of the metal flaps to be twisted.

Figure 5:
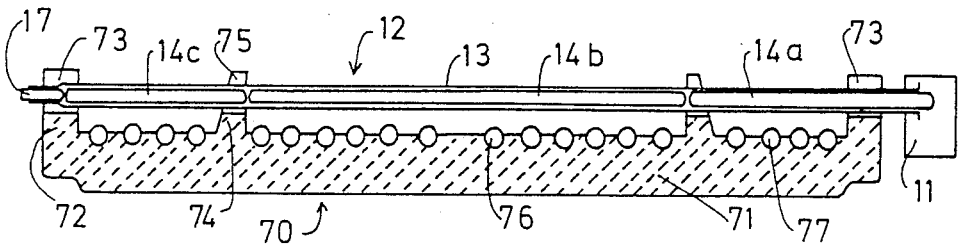
FIG. 5 shows diagrammatically the arrangement of a temperature sensor over a heating system of a glass-ceramic cooking unit with two separate heating surfaces.

FIG. 2 shows the lever 23 in a position which it cannot normally occupy without the inner rod 14. This was done to make the drawing clearer. The inner rod 14 comprises a number of component rods 14*a*,14*b*, only two of which are shown in FIG. 1. Three component rods are shown in FIG. 5, which remains to be dealt with. Of course, a larger number of rods can also be used.

The provision of a number of component rods has the advantage on the one hand of simplifying storage, if the inner rods are built up from a number of component rods of identical size. On the other hand, if the outer tube becomes slightly bent, the inner rod cannot get jammed, as would be possible with a one-piece inner rod. Again, the construction from a number of component rods allows the use of component rods of different materials and with different coefficients of expansion.

Slipped over the outer tube 13 of the temperature senser 12 is a quartz glass protective tube 51 whose end 52 remote from the base engages with clearance in the cap 16. The cap 16 has a circularly extending, outwardly directed edge 53, so that the cap can be inserted in an opening in a sheet metal plate without the possibility of its getting lost.

Figure 3:
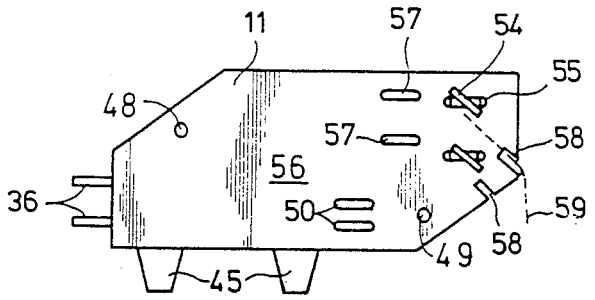
FIG. 3 is a view of the base from below.
Figure 4:
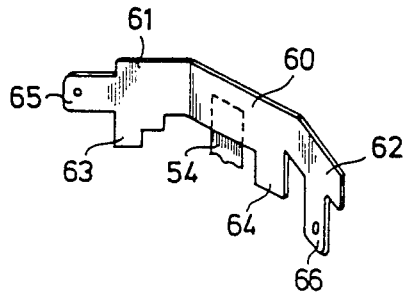
FIG. 4 is a perspective view of an attaching strap.

FIG. 3 shows the slots 50 for locating the base side end of the outer tube 13 and also the connecting parts 54 of the signal switch 29. They also are inserted through slots 55 in the bottom 56 of the base 11 and then twisted, so that the parts of the switch are precisely located. The bottom 56 also has in the zone of the connecting parts 54 further notches 57,58 the notches 57 extending substantially parallel, but offset in relation to the slots 55, while the notches 58 extend parallel with the twisted connecting parts 54 of the signal switch 29. In FIG. 3 the chain line 59 shows in what geometrical relationship the notches 57,58 extend in relation to the connecting part 54. Welded to the switch part 54 is a strap 60 (FIG. 4) which extends along the line 59. Just like the line 59, the strap 60 is bent twice on the longitudinal direction, so that its two ends 61,62 are bent down in relation to the rectilinear central part. In the rectilinear central part the strap 60 is welded to the connecting part 54 (merely outlined in FIG. 4). The strap 60 has on its underside two attachments 63,64, of which the attachment 63 engages in the notch 57, the attachment 64 engaging in the notch 58. When the strap 60 is welded tight, therefore, it bears firmly against the bottom 56 of the base 11, so that when connecting wires are attached to the strap 60 no forces can be transmitted to the switch parts of the signal switch 29, which when once adjusted therefore remains so.

One end 61 of the strap 60 has a first flat insertion tongue 65, while the other end 62 has a second flat insertion tongue 66 directed at right angles downwards. The two flat insertion tongues preferably are of different sizes, so that different insertion devices can be used.

FIG. 5 shows diagrammatically the arrangement of the temperature sensor 12 in a glass-ceramic cooking unit having the form of a moulding 70 for receiving the heating systems. The moulding 70 has a flat bottom 71 and a circularly extending flat cylindrical flange 72 with aperture 73 for receiving the temperature sensor 12. To simplify matters, the drawing does not show the sheet metal plate to which the arrangement comprising the temperature sensor 12 and base 11 is attached. Consentrically with the circularly extending flange 72 the moulding 70 has a circularly extending rib 74 having the same height as the flange 72. The rib 74 is also formed with perforations 75 for receiving the temperature senser 12.

The electrical heating systems 76, 77 are disposed on the top side of the bottom 71 of the moulding 70. The glass-ceramic cooking unit can be operated either merely with the electric heating system 76, or with the electric heating systems 76 and 77. For this reason the space inside the rib 74 forms a central heating surface, while the annular space between the rib 74 and the flange 72 forms a connectable heating surface.

The inner rod 14 of the temperature sensor 12 (FIG. 5) is subdivided into three component rods 14*a*, 14*b* and 14*c*. As can be seen, the central component rod 14*b* extends substantially over the zone inside the rib 74—i.e., an arrangement and dimensions it corresponds to the central heating surface. The two other component rods 14*a*, and 14*c* are disposed in contrast in the zone between the rib 74 and the flange 72—i.e., in arrangement and size they correspond to the connectable heating surface.

In order to adjust accurately the response temperature of the switch contained in the base 11 independently of whether only the heating system 76 or the heating system 77 also is switch on, the outer component rods 14*a*, 14*c*—i.e., those associated with the connectable heating surface—have a coefficient of expansion which differs from the coefficient of expansion of the central component rod 14*b*. The outer tube 13 consists entirely of the same material.

Preferably the tube 13 is of high-quality steel and the inner component rod 14*b* of ceramics, so that it has a lower coefficient of expansion than the outer tube 13. To eliminate the influence of the connectable electric heating system 77, the coefficient of expansion of the component rods 14*a*, and 14*c* is at least as high as that of the outer tube 13, but preferably higher. As a result the influence of the connectable electric heating system 77 is practically overcompensated.

With a converse arrangement—i.e., one in which the coefficient of expansion of the central inner rod 14*b*, was higher than that of the outer tube 13, accordingly the coefficient of expansion of the component rods 14*a*, 14*c* would be at most as high as that of the outer tube 13, but advantageously lower.

While in the temperature switch illustrated in FIG. 1 the temperature sensor acts on two separate switches, one of which is used for indicating the heating condition and the other for switching the electric heating system, the step according to the invention can of course also be used if only one switch is to be actuated, for example, only for a heating indication or only as a temperature limiter.

Figure 6:
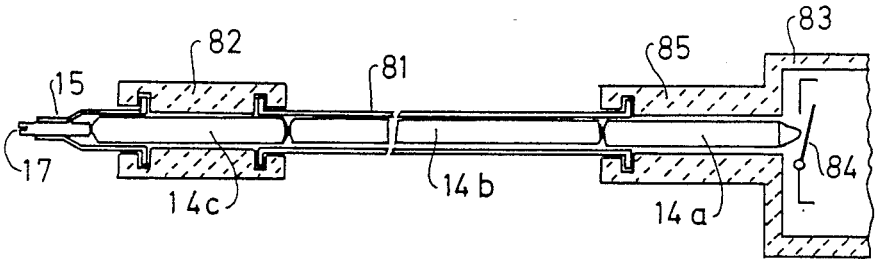
FIG. 6 shows diagrammatically a further embodiment of a temperature limiter.

While in the embodiment illustrated in FIGS. 1 and 5 the outer tube was in one piece, in the embodiment illustrated in FIG. 6 the outer tube 81 is in one piece only in its central zone, being continued towards the free end 15 of the temperature senser by a portion 82 which consists of another material, in this case ceramics. The casing 83 of the diagrammatically indicated switch has on its side adjacent the glass-ceramic cooking unit a substantially cylindrical attachment 84, whose length corresponds substantially to the distance between the outer flange 72 and the shoulder 74 of the moulding (FIG. 5). In this example the central portion 81 of the outer tube has a higher coefficient of expansion than the portion 82 and the attachment 85, while at the same time the component rods 14*c* also have a higher coefficient of expansion than the central component rod 14*b*. For example, the central portion of the outer tube can be made of the same material as the outer component rods 14*c*, while on the other hand the central component rod 14*b* is made of ceramics, like the portion 82 and the attachment 85 of the casing 83. The arrangement of the embodiment illustrated in FIG. 6 would be so that the central part 81 of the outer tube was disposed above the central heating surface, while the attachment 85 and the portion 82 would be disposed above the connectable heating surface.

The arrangement of the temperature sensor 12 can also be that, starting from the arrangement illustrated in FIG. 5, the temperature sensor 12 extends from the outer flange 72 of the moulding 70 via the rib 74 as far as the opposite rib 74 and terminates there. In that case the over-compensation illustrated would take place only in the zone of the component rod 14*a*.

Of course, the component rod, e.g., 14*b* associated with the basic heating surface, and/or the component rods 14*a*,14*c* associated with the connectable heating surface can themselves also be made up of individual component rods.

It has been found to be particularly advantageous if, as a further feature of the invention, the at least single component rod associated with the connectable heating surface is constructed hollow, more particularly in the form of a tube. The result is a reduced transverse heat conduction, so that an even reduced and clearer separation can be achieved between the basic heating surface and the connectable heating surface.

What is claimed is:

1. A temperature limiter for a glass-ceramic cooking unit, comprising:

a substantially rod-shaped sensor which has an outer tube containing an inner rod with a differennt coefficient of expansion, the inner rod comprising a number of component rods, the inner rod actuating a signal switch disposed in a base to indicate a heating state potentially harmful to users of the glass-ceramic cooking surface, and the inner rod actuating via a pivotable lever a circuit breaker also disposed in the base for switching the heating system of the glass-ceramic cooking unit off at a limiting temperature potentially harmful to the cooking unit, the limiting temperature lying just below a permissible temperature of the glass-ceramic cooking surface, the outer tube being rigidly connected to the base and the actuating point of the signal switch lying on the axis of the inner rod, so that the inner rod directly actuates the signal switch, and force being transmitted from the lever to the circuit breaker by an adjusting screw and a flat-head rivet which is attached to the free end of a drag lever attached to the lever and has at least one flat bearing surface and is disposed resiliently between the adjusting screw and the actuating point of the circuit breaker.

2. A temperature limiter according to claim 1, wherein the flat-head rivet has two flat bearing surfaces.

3. A temperature limiter for a glass-ceramic cooking unit, comprising:

an elongate outer tube containing an inner rod, relative movement between the outer tube and the inner rod being made possible by their different coefficients of expansion, acting on an electric switch, wherein for use with a cooking unit having at least one additional heating surface controllably operable with a basic heating surface, the inner rod is subdivided into component rods substantially corresponding to a subdivision between the basic heating surface and the at least one additional heating surface into a basic zone and an additional zone, and the coefficient of expansion of the component rod associated with the basic heating surface differs from the coefficient of expansion of the additional component rod associated with the additional heating surface.

4. A temperature limiter according to claim 3, comprising a basic component rod whose coefficient of expansion is lower than that of the outer tube in the basic zone, and the coefficient of expansion of the additional component rod is at least as high as that of the outer tube in the additional zone.

5. A temperature limiter according to claim 3, comprising a basic component rod whose coefficient of expansion is higher than that of the outer tube in the basic zone, and the coefficient of expansion of the additional component rod is less than that of the outer tube in the additional zone.

6. A temperature limiter according to claim 3, wherein the temperature limiter extends from an outer edge of the cooking unit past its center at least as far as in opposite, separating place between the basic heating surface and the additional heating surface.

7. A temperature limiter according to claim 3, wherein the outer tube is at least partially unitary with a casing of the switch acted upon by the temperature senser.

8. A temperature limiter according to claim 3, wherein the component rod associated with the basic heating surface is constructed as a small tube.

9. A temperature limiter according to claim 3, wherein of two adjoining ends of two component rods at least one end is flat.

10. A temperature limiter according to claim 9, wherein both ends of the two component rods are flat.

11. A temperature limiter for a a glass-ceramic cooking unit having an elongate outer tube containing an inner rod, relative movement between the outer tube and the inner rod being made possible by their different coefficients of expansion, acting on an electric switch, wherein for use with a cooking unit having at least one additional heating surface connectable to a basic heating surface, the outer tube is subdivided into component tubes substantially corresponding to a subdivision between the basic heating surface and the at least one additional heating surface, and the coefficient of expansion of at least one component tube associated with the basic heating surface differs from the coefficient of expansion of at least one component tube associated with the additional heating surface.

12. A temperature limiter for a glass-ceramic cooking unit, comprising:

a substantially rod-shaped sensor which has an outer tube containing an inner rod with a different coefficient of expansion, the inner rod comprising a number of component rods, the inner rod actuating a signal switch disposed in a base to indicate a heating state potentially harmful to users of the glass-ceramic cooking surface, and the inner rod actuating via a pivotable lever a circuit breaker also disposed in the base for switching the heating system of the glass-ceramic cooking unit off at a limiting temperature potentially harmful to the cooking unit, the limiting temperature lying just below a permissible temperature of the glass-ceramic cooking surface, the outer tube being rigidly connected to the base and the actuating point of the signal switch lying on the axis of the inner rod, so that the inner rod directly actuates the signal switch, the base being borne by two connecting parts engaging in slots with which a sheet metal plate of the heating system is formed, and further comprising an additional bowed member between the base and the sheet metal plate.

* * * * *